US006508254B1

(12) United States Patent
Mua et al.

(10) Patent No.: US 6,508,254 B1
(45) Date of Patent: Jan. 21, 2003

(54) REDUCED PROTEIN RECONSTITUTED TOBACCO AND METHOD OF MAKING SAME

(75) Inventors: John-Paul Mua, Macon, GA (US); Terryl V. Baker, Stockbridge, GA (US); Kenneth John Bradley, Jr., Macon, GA (US); William R. Conway, Macon, GA (US); Walter M. Drexler, Cartersville, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 66 days.

(21) Appl. No.: 09/612,119

(22) Filed: Jul. 7, 2000

(51) Int. Cl.[7] ..... A24B 15/24

(52) U.S. Cl. ..... 131/297; 131/300; 131/309; 131/312; 131/356

(58) Field of Search ..... 131/297, 300, 131/309, 356, 312

(56) References Cited

U.S. PATENT DOCUMENTS

| | | | | | |
|---|---|---|---|---|---|
| 3,145,717 | A | * | 8/1964 | Osborne et al. | |
| 3,306,307 | A | | 2/1967 | Richards | |
| 3,628,541 | A | | 12/1971 | Buchmann et al. | |
| 3,860,012 | A | * | 1/1974 | Seike | 131/140 |
| 4,183,364 | A | | 1/1980 | Gumushan et al. | |
| 4,256,126 | A | | 3/1981 | Seligman et al. | |
| 4,289,147 | A | | 9/1981 | Wildman et al. | |
| 4,347,859 | A | | 9/1982 | Bokelman et al. | |
| 4,489,739 | A | | 12/1984 | Mattina, Jr. et al. | |
| 4,716,911 | A | * | 1/1988 | Poulose et al. | 131/297 |
| 4,887,618 | A | * | 12/1989 | Bernasek et al. | 131/297 |
| 4,941,484 | A | * | 7/1990 | Clapp et al. | 131/297 |
| 4,987,906 | A | * | 1/1991 | Young et al. | 131/297 |
| 5,131,414 | A | * | 7/1992 | Fagg et al. | 131/297 |
| 5,148,821 | A | | 9/1992 | Best et al. | |
| 5,311,886 | A | * | 5/1994 | De Grandpre et al. | 131/297 |
| 5,322,076 | A | | 6/1994 | Brinkley et al. | |
| 5,343,879 | A | * | 9/1994 | Teague | 131/297 |
| 5,435,325 | A | * | 7/1995 | Clapp et al. | 131/297 |
| 5,601,097 | A | | 2/1997 | De Grandpreet et al. | |
| 5,765,570 | A | * | 6/1998 | Litzinger et al. | 131/370 |

FOREIGN PATENT DOCUMENTS

| | | |
|---|---|---|
| GB | 884 435 | 12/1961 |

* cited by examiner

*Primary Examiner*—Steven P. Griffin
*Assistant Examiner*—Carlos Lopez
(74) *Attorney, Agent, or Firm*—James Daly, IV; Middleton Reutlinger

(57) ABSTRACT

A process for manufacturing reconstituted tobacco with reduced nitrogenous content by submitting cured tobacco material, including whole leaf, stems, scraps, fines and lamina, as well as burley leaf and stem, to an extraction with a solution containing sodium acetate, sodium hydroxide, potassium hydroxide or mixtures thereof. The extraction process, in addition to denitrifying the tobacco material, also produces reconstituted tobacco paper with characteristics similar to flue cured tobacco leaf.

45 Claims, 1 Drawing Sheet

REDUCED PROTEIN RECONSTITUTED TOBACCO AND METHOD OF MAKING SAME

BACKGROUND OF THE INVENTION

1. Field of the Invention

This invention relates generally to tobacco and reconstituted tobacco smoking materials and methods of making same. More particularly, the present invention relates to the materials and methods that provide tobacco materials with reduced nitrogenous content and also provide reconstituted tobacco paper with leaf-like characteristics.

2. Description of the Related Art

Tobacco material contains various nitrogenous compounds that can adversely affect its smoke quality. Among these nitrogenous compounds are proteins, amino acids and certain alkaloids, such as nicotine, nornicotine, anabasine and anatabine. The smoke quality of tobacco is adversely affected particularly by heterocyclic and aromatic amines, and tobacco specific nitrosamines (TSNA), as well as other compounds formed by pyrolysis or transfer of these nitrogenous compounds. Tobacco processing sometimes includes steps in which the nitrogen content of the tobacco is reduced, so as to improve the smokability of the tobacco. However, nitrogenous compounds, especially proteins, are difficult to extract from cured tobacco lamina, stem, and fiber cell walls.

Insoluble proteins make up more than 90% of the total proteins found in cured tobacco. These insoluble proteins are globular in conformation, and are bound to lipoidal organocellular membranes of fiber or cellulose cell walls. Solubilization and extraction of these insoluble proteins have traditionally proven difficult when using water or solvents under moderate digestion conditions (i.e. less than 100° C. and 65–70 psig) and with shredded tobacco of size suitable for cigarette manufacture. This difficulty is due in large part to the compact and rigid structure of fiber cells. Penetration of rigid cell wall structure by solvents has proven feasible only after thermal and/or mechanical sample treatment. However, the common result of such sample treatment is poor recovery of the solvated particulate material. Moreover, cell wall penetration does not necessarily lead to protein solubilization, since plant proteins differ in their conformity and solubilization patterns. More specifically, plant proteins are divided into four major classes: albumins; globulins; prolamins (also known as gliadins); and, glutelins. Albumins are soluble in water, whereas globulins are soluble in dilute salt solutions. Prolamins are soluble in dilute acid or alkali solutions, while glutelins are soluble in alcohol solutions. Some proteins, however, overlap into two of these four classifications, thereby increasing the difficulty of accurately predicting the appropriate diluent.

Many of the current processes used to reduce nitrogen content in tobacco material employ enzymatic compounds and microbial agents to break down the proteins and other nitrogen-containing compounds within the tobacco. However, disadvantages arise from the use of such enzymatic compounds and agents. In particular, enzymes are expensive, pH sensitive and degrade proteins into amino acids which tend to remain with the tobacco material. It is also thought that enzymatic compounds leave residues on tobacco material after processing. Furthermore, microbial agents used in treating tobacco tend to cause unwanted reactions that generate undesirable by-products.

Therefore, there is a need to provide a process by which the nitrogen content of tobacco material may be reduced without leaving residues or undesirable by-products. This process must provide effective solubilization of proteins and other nitrogenous compounds, as well as adequate particulate matter recovery.

SUMMARY OF THE INVENTION

The present invention relates to a method for providing a reconstituted tobacco material having a reduced nitrogenous content. The tobacco material in the form of flue cured and burley whole leaf, stems, fines, lamina or scraps, and/or burley stems are contacted with an aqueous solvent. The resulting liquid extract is separated from the tobacco fiber portion. The tobacco fiber portion is then contacted with a solution containing sodium acetate and/or sodium hydroxide and/or potassium hydroxide. This solution is also separated from the tobacco fiber portion. The tobacco fiber portion may then be washed, refined and processed into reconstituted tobacco sheets. The liquid extract from the aqueous solvent extraction may be concentrated and added back to the sheets. These sheets may then be used in smoking articles, such as cigarettes. The reduction of nitrogenous compounds in the tobacco material provides for improved smokability and a reduction in nitrogen containing pyrolitic products emitted from smoking articles which contain the tobacco material.

It is an object of the present invention to provide a reconstituted tobacco material with reduced levels of nitrogenous compounds.

It is another object of the present invention to provide a method of making a reconstituted tobacco material with reduced levels of nitrogenous compounds.

It is a further object of the present invention to provide a reconstituted tobacco material paper with a cured tobacco leaf-like texture.

More particularly, the present invention is directed to a method for reducing the nitrogenous content of tobacco material, including cured tobacco whole leaf, fines, scraps, stems, and lamina, as well as burley leaf and stem, comprising the steps of: contacting tobacco material with a first aqueous solvent, such as water, at a temperature of about 60° C. to 80° C. for about 0.5 to 1 hour; separating the aqueous tobacco extract from the tobacco fiber portion; contacting this washed tobacco fiber portion with a solution containing 0.10% to 10% (weight/volume) sodium acetate and/or 0.1% to 10.0% (weight/volume) sodium hydroxide and/or 0.1% to 10.0% (w/v) potassium hydroxide at a pH of about 3.5 to 14 and a temperature of about 50° C. to 150° C. for about 0.25 to 24 hours; and, then separating the solution from the tobacco fiber portion. Preferably, the solution will contain about 0.75% to 1.0% (w/v) sodium acetate and/or 0.5% to 1.0% (w/v) sodium hydroxide and/or 0.5% to 1.0% (w/v) potassium hydroxide.

Furthermore, the present invention is directed to a reconstituted tobacco sheet formed from the tobacco material treated according to the above method. The reconstituted tobacco sheet, formed from tobacco material treated according to the method in which the solution contains sodium hydroxide or potassium hydroxide in the absence of sodium acetate, exhibits physical characteristics superior to those exhibited by reconstituted tobacco sheets formed by conventional or other methods. More particularly, a reconstituted tobacco sheet formed from tobacco material treated thus has a texture and density similar to that of cured tobacco leaf. This tobacco sheet, when cut, is less likely to crumble than a reconstituted tobacco sheet formed by conventional methods, and it is stronger than either cured tobacco leaf or conventional reconstituted tobacco sheet.

A better understanding of the present invention will be realized from the hereafter processes and the Examples following such description

DESCRIPTION OF THE PREFERRED EMBODIMENT

Figure 1:
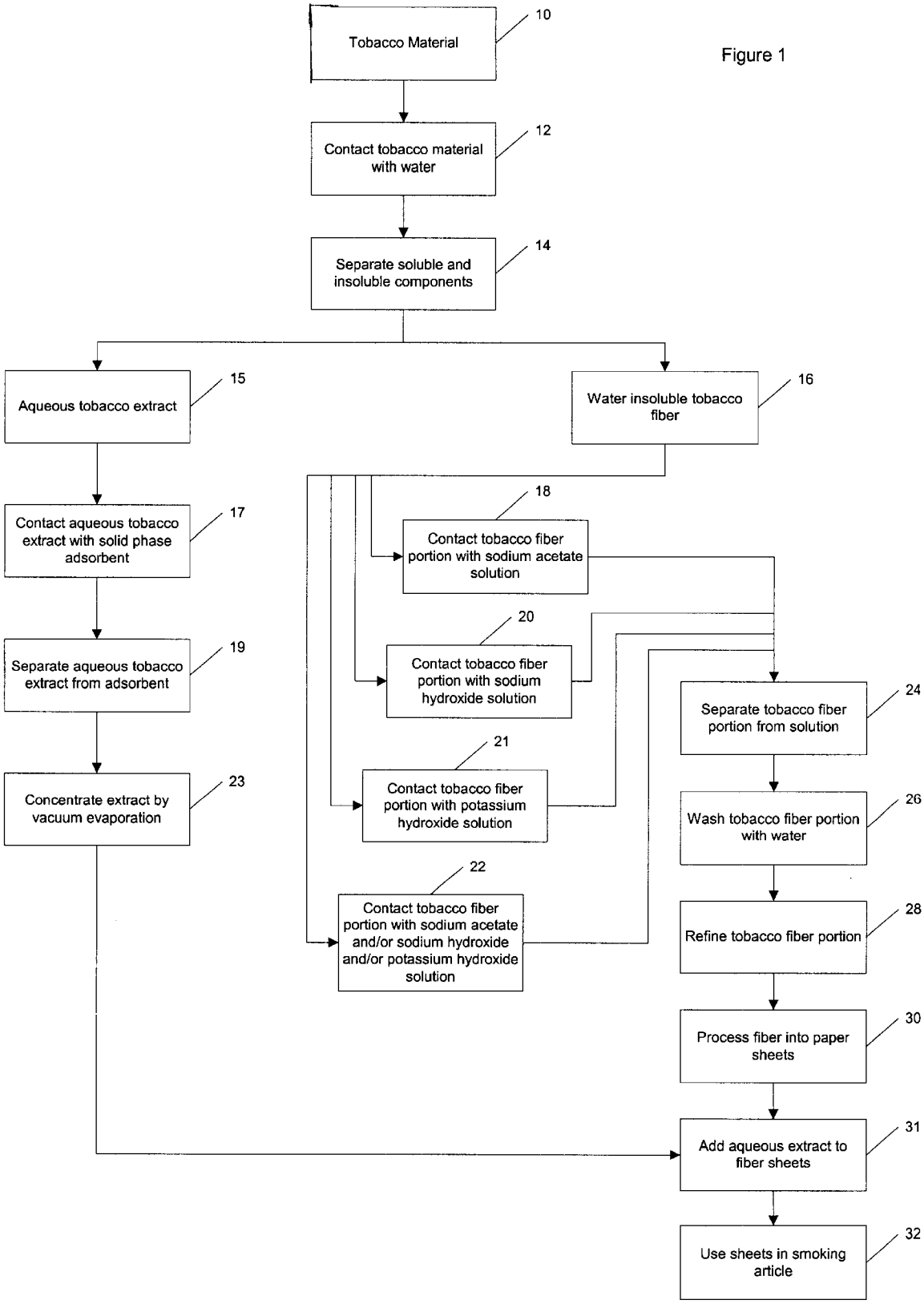
FIG. 1 is a schematic of the process steps representative of the present invention.

In a preferred method of carrying out the nitrogen reduction process of the present invention, tobacco materials 10 in the form of flue cured and burley stems, scraps, fines, and lamina are contacted with a first aqueous solvent, such as water, at a temperature of about 60° C. to 80° C. for about 0.5 to 1 hour 12. The contacting of the tobacco with the water 12 may be conducted in a tank or similar mixing vessel in which the water and tobacco are heated and agitated. The resulting aqueous tobacco extract, containing flavor compounds, is separated from the tobacco fiber portion, preferably by centrifugation 14. The tobacco/water slurry may be pumped into a centrifuge from the mixing vessel and centrifugally separated therein. Once removed from the tobacco fiber portion, the aqueous tobacco extract 15 may be reserved for reapplication to the fiber with or without separate processing. In one embodiment, the aqueous tobacco extract 15 may deproteinated by contacting it with a solid phase adsorbent 17, such as Bentonite, in a vessel and then separated therefrom by centrifugation 19, or a similar separation process well known in the art. The nitrogen-reduced aqueous tobacco extract containing flavor compounds may then be concentrated 23 by vacuum evaporation, and added back to a reconstituted tobacco paper 31.

The nitrogen content of the tobacco fiber portion 16 separated from the aqueous tobacco extract 15 may be reduced by contacting the tobacco fiber portion 16 with a solution containing a mild salt, such as sodium acetate 18, and/or an alkali, such as sodium hydroxide 22 and 20 and/or potassium hydroxide 21 and 22. The tobacco fiber portion 16 may be loaded into a tank or similar mixing vessel. In one embodiment, a solution containing a mass concentration from about 0.25% to 10% (weight/volume) sodium acetate (NaOAc) 18 may be charged to the vessel and contacted with the washed tobacco fiber portion at a temperature of about 50° C. to 150° C. for about 0.25 to 24 hours. Preferrably, the solution will contain about 0.75% to 1.0% (w/v) sodium acetate and be contacted with the tobacco fiber portion at a pH of 3.8 to 5.0 and a temperature of from about 60° C. to 70° C. for about 12 to 24 hours. Afterward, the solution may be separated from the tobacco fiber portion by any means well known in the art 24, preferably by pumping the slurry to a centrifuge wherein the fiber is centrifugally separated from the solution. The tobacco fiber portion may then be washed with second aqueous solvent, such as water, as noted by numeral 26, and further refined 28. The tobacco fiber portion may then be processed into sheets 30, to which may be added nitrogen-reduced aqueous tobacco extract 31.

When burley material is treated with a solution containing sodium acetate according to this process, instead of non-burley material described above, fibrous burley material is preferably contacted with a solution containing about 0.75% to 1.0% (w/v) sodium acetate at a pH of about 3.5 to 11.0 and at a temperature of about 50° C. to 90° C. for about 0.50 to 0.75 hours. The liquid extract from the initial washing is usually not added back to the processed sheets when burley stem is processed in this manner.

Two alternative embodiments of the nitrogen reduction process of the present invention include the initial water extraction step described herein above. However, in these two embodiments, sodium hydroxide may be added to 22, or substituted for 20, the sodium acetate. More specifically, instead of the solution described above, the tobacco fiber portion may be extracted with a solution containing about 0.1% to 10% (w/v) sodium hydroxide (NaOH), either in combination with sodium acetate and/or potassium hydroxide 22, or in the absence of sodium acetate and potassium hydroxide. If the solution contains sodium hydroxide without either sodium acetate or potassium hydroxide, then the tobacco fiber portion should be contacted with the solution for about 3.0 to 7.0 hours at a temperature of from about 50° C. to 150° C. Preferably, the tobacco fiber portion is contacted with a solution containing about 0.5% to 1.0% (w/v) sodium hydroxide for about 3 to 4 hours at a temperature of from about 85° C. to 90° C. The solution may thereafter be separated from the tobacco fiber portion by a method well known in the art, as noted by numeral 24, such as centrifugation. The nitrogen-reduced tobacco fiber portion may then be contacted with a second aqueous solvent, such as water 26, refined 28 and formed into sheets 30, to which liquid extract containing flavor compounds from the initial washing is added, as noted by numeral 31, for use in a smoking article 32, such as a cigarette.

Additionally, potassium hydroxide (KOH) may be included in the solution with which the tobacco fiber portion is contacted. As indicated by numeral 21, the tobacco fiber portion may be contacted with a solution containing potassium hydroxide, or, as in numeral 22, the solution may contain potassium hydroxide along with sodium acetate and/or sodium hydroxide. Any one of the solutions set forth in numerals 21 and 22 may contain about 0.10% to 10% (w/v) potassium hydroxide. Preferably, these solutions may contain about 0.5% to 1.0% (w/v) potassium hydroxide. The solution 21 containing potassium hydroxide in the absence of sodium acetate and sodium hydroxide may be contacted with the tobacco fiber portion for about 3 to 7 hours at a temperature of about 50° C. to 150° C. Preferably, the tobacco fiber portion is contacted with the solution containing potassium hydroxide 21 for about 3 to 4 hours at a temperature of 80° C. to 90° C. The solution containing potassium hydroxide, sodium acetate and/or sodium hydroxide 22 may be contacted with the tobacco fiber portion for about 0.25 to 24 hours at a temperature of about 50° C. to 150° C.

When the tobacco material being treated with sodium hydroxide or potassium hydroxide is burley stem, the fibrous portion is preferably contacted with a solution containing about 0.25% to 0.75% (w/v) sodium hydroxide or potassium hydroxide at a temperature of about 85° C. to 90° C. for about 0.5 to 3 hours. Again, the liquid extract separated from the tobacco fiber portion in the initial washing with the first aqueous solvent is not added back to the reconstituted tobacco paper when the tobacco material is burley stem.

The reconstituted tobacco paper formed from the process described above, particularly the embodiment in which the solution contains sodium hydroxide or potassium hydroxide 22 in the absence of sodium acetate exhibits unique physical characteristics. These unique characteristics are exhibited by reconstituted tobacco papers formed from both flue cured and burley tobacco. In particular, the tobacco sheet formed from tobacco material treated with sodium hydroxide 20 or potassium hydroxide 22 is stronger than reconstituted tobacco paper formed by conventional methods. Also, this tobacco sheet exhibits a texture and a density that are similar to that exhibited by flue cured tobacco leaf. This reconstituted tobacco paper, when cut, will not crumble as easily as paper formed by conventional methods. Therefore, less tobacco paper is wasted in the process of making smoking articles, such as cigarettes. Thus, reconstituted tobacco paper formed by the above described process provides advantages in the cigarette making process over conventionally formed reconstituted tobacco paper.

Prior to addition of the nitrogen-reduced aqueous tobacco extract, the sheets formed from tobacco treated by the preferred embodiments of this process exhibit reductions of 28% to 93% (dry weight basis) in Kjeldahl nitrogen and 19% to 81% protein nitrogen when compared to sheets made via the conventional process, as shown in Table 1. After addition of the nitrogen-reduced liquid extract, these reconstituted tobacco sheets exhibit final reductions of 23% to 40% (d.w.b) in Kjeldahl nitrogen, and 22% to 56% in protein nitrogen, as shown in Table 1.

EXAMPLES

For a better understanding of the present invention, the following Examples are incorporated herein to illustrate the present invention with no intention of being unduly limited thereby.

Example 1

A 6.8 kg mixture of tobacco materials, including flue cured and burley tobacco scraps, stems, laminae and fines having a nitrogen content of 2.25% was extracted with water at 60° C. for 30 minutes as known in the art. Following centrifugation, the liquid extract was further treated with diatomaceous clay, to remove nitrogenous compounds, and then concentrated by vacuum evaporation. The resultant washed fiber was further extracted to remove nitrogenous compounds, as mentioned below. From the washed fibers, 80 g portions were then loaded into vessel containing 400 ml of 1.0% (w/v) sodium acetate at a pH 3.8, 5.0, 8.3, or 11.0,

TABLE 1

Reductions in Kjeldahl nitrogen, protein nitrogen, and nitrate of tobacco extracted with salt and/or alkali solutions

| | | Extraction Conditions | | | | | Nitrogen components (%) | | |
|---|---|---|---|---|---|---|---|---|---|
| Example | Starting material | Chemical | Soln (%) | pH | Temp (° C.) | Time (h) | Kjeldahl | Protein | Nitrate |
| Control 1 | Ground stock[a] | — | — | — | — | — | 2.25 | — | 2.71 |
| Control 2 | Ground stock | Water | 100 | 6.8 | 60–80 | 0.5–1.0 | 1.72 | — | trace |
| Control 3 | Conventional sheet without added extract | — | — | — | — | — | 1.47 | 1.15 | 0.00 |
| Control 4 | Conventional sheet with extract added back | — | — | — | — | — | 2.22 | 0.85 | 3.41 |
| Control 5 | Shredded Burley stem | — | — | — | — | — | 2.45 | 0.90 | 7.7 |
| Control 6 | Shredded Burley stem | Water | 1.00 | 6.8 | 60 | 0.5 | 2.13 | — | 1.49 |
| 1a | Washed fiber[a] | NaOAc | 1.00 | 3.8 | 60 | 24 | 0.10 | 0.10 | bcl[c] |
| 1b | Washed fiber | NaOAc | 1.00 | 5.0 | 60 | 12 | 1.06 | 0.93 | bcl |
| 1c | Washed fiber | NaOAc | 1.00 | 8.3 | 60 | 12 | 1.04 | 0.93 | bcl |
| 1d | Washed fiber | NaOAc | 1.00 | 11.0 | 60 | 12 | 1.06 | 0.93 | bcl |
| 2 | Shredded Burley stem | NaOAc | 1.00 | 3.8 | 60 | 18 | 0.33 | — | 0.05 |
| 3 | Washed fiber | NaOH | 1.50 | 12.5 | 88 | 12 | 1.06 | — | bcl |
| 4 | Shredded Burley stem | NaOH | 1.00 | 12.5 | 60 | 12 | 0.86 | — | 0.05 |
| 5a | Washed fiber | NaOH | 0.25 | 12.5 | 88 | 3 | 0.57 | — | bcl |
| 5b | Washed fiber | NaOH | 0.50 | 12.5 | 88 | 3 | 0.44 | 0.35 | bcl |
| 5c | Washed fiber | NaOH | 0.75 | 12.5 | 88 | 3 | 0.25 | 0.22 | bcl |
| 5d | Washed fiber | NaOH | 1.00 | 12.5 | 88 | 3 | 0.28 | 0.28 | bcl |
| 5e | Washed fiber | KOH | 0.50 | 12.5 | 88 | 3 | 0.83 | — | bcl |
| 5f | Washed fiber | KOH | 0.75 | 12.5 | 88 | 3 | 0.69 | — | bcl |
| 6a | Washed fiber | NaOAc/ KOH | 0.75 0.25 | — | 88 | 4 | 1.00 | 0.93 | bcl |
| 6b | Washed fiber | NaOAc/ NaOH | 0.75 0.25 | — | 88 | 4 | 0.69 | — | bcl |
| 6c | Washed fiber | NaOAc/ KOH | 0.50 0.50 | — | 88 | 4 | 0.71 | — | bcl |
| 7a | Shredded Burley stem | NaOAc | 1.00 | 11.0 | 121 20 psi | 0.5 | 0.40 | — | 0.07 |
| 7b | Shredded Burley stem | NaOH | 0.25 | 12.5 | 80 | 0.5–0.75 | 0.69 | — | 0.04 |
| 7c | Shredded Burley stem | NaOH | 0.50 | 12.5 | 80 | 0.5–0.75 | 1.05 | — | 0.07 |

[a]Formula including flue-cure/burley srcap, stem, fines, lamina, and binder.
[b]Solids collected after ground stock including binder have been extracted with water at 60–80° C. for 0.5 h.
[c]bcl = below calibration limits.

which are Examples 1a, 1b, 1c, 1d, respectively, shown in Table 1. The sodium acetate solution containing the tobacco material was then heated to 60° C. for 12 to 24 hours while being agitated. After this period of heating and agitation, the liquid was separated from the tobacco fiber portion through centrifugation. The solids were rinsed with water. The final fibrous residue was then dried for 24 hours at 35° C. The sample was then tested for Kjeldahl nitrogen content and found to have a Kjeldahl nitrogen content of 1.06% to 0.1%, exhibiting a reduction of 53.0% to 95.5% (d.w.b) from the initial Kjeldahl nitrogen content of the tobacco material of Control 1 shown in Table 1. The fibrous material was then refined and formed into paper-like sheets on a Fourdrinier type wire papermaking machine.

Example 2

Burley stem of Control 5 shown in Table 1 having a Kjeldahl nitrogen content of 2.45%, a protein content of 0.9%, and a nitrate content of 7.7% was shredded in a Waring blender at low speed for 30 seconds and then 80 gram samples were dispersed and agitated in 400-ml solution of 1.0% (w/v) sodium acetate (pH 3.8) for 18 hours which is Example 2 shown in Table 1. The liquid and solid portions were then separated by centrifugation and the tobacco stems were dried. The resulting fibrous material was found to have a nitrogen content of 0.33% and a nitrate content of 0.05%, exhibiting a reduction in Kjeldahl nitrogen of 86.5% (d.w.b), and nitrate reduction of 99.3% (d.w.b.), as compared to the burley stem of Control 5 of Table 1.

Example 3

This example was carried out in the same manner and with the same quantities of materials as in Example 1, the only changes being that the 400-ml solution contained 1.5% (w/v) sodium hydroxide at a pH of 12.5, shown in Table 1 as Example 3. The resulting fibrous material had a 52.9% reduction in Kjeldahl nitrogen. The 12 hour extraction resulted in >60% solids loss due to fiber degradation. However, the paper-like sheet formed from this extracted residue exhibited characteristics that made it superior to conventional reconstituted paper. More specifically, the paper formed from the tobacco material treated with sodium hydroxide was light and unexpectedly strong. Unlike conventional reconstituted paper, the paper's density and texture were very similar to flue cured tobacco leaf, but it was significantly stronger than either flue cured tobacco leaf or conventional reconstituted paper.

Example 4

This example was carried out in the same manner and with the same quantities of materials as that utilized in example 2, except that the 400 ml solution contained 1.0% (w/v) sodium hydroxide at a pH of 12.5, instead of sodium acetate. The resulting residue exhibited a 65% reduction in Kjeldahl nitrogen, and a 99.3% reduction in nitrate as compared to Control 5 shown in Table 1. The resulting paper-like sheet formed exhibited similar advantages to those exhibited by the sheet formed in Example 3. Excessive loss in solids was also observed as in Example 3.

Example 5

This example was carried out in the same manner as Example 1, except that 350 g portions of washed fiber were extracted in a vessel with 3L of 0.25%, 0.5%, 0.75%, or 1.0% (w/v) sodium hydroxide at 88° C. for 3 h, which are Examples 5a, 5b, 5c, 5d, respectively, of Table 1. The resulting paper showed a 74.7% to 88.8% reduction in Kjeldahl nitrogen as compared to Control 1 shown in Table 1. The resulting paper-like sheet exhibited similar advantages to those formed in Example 3 and 4.

Example 6

This example was carried out in a similar manner as Example 5, except that extraction time was 4 h and the 3L solutions were made up of 0.75% (w/v) sodium acetate and 0.25% (w/v) potassium hydroxide, 0.75% (w/v) sodium acetate and 0.25% (w/v) sodium hydroxide, or 0.5% (w/v) sodium acetate and 0.5% potassium hydroxide. The resulting paper showed a 55.5% to 69.3% reduction in nitrogen, as compared to the ground stock of Control 1 shown in Table 1. The resulting sheets did not show the paper quality advantages exhibited by those in Example 3, 4, and 5.

Example 7

Burley stem was shredded in a double disc shredder and then 350 g portions were dispersed in 3L of 1% (w/v) sodium acetate at a pH 11.0, which is Example 7a shown in Table 1, and in 3L of 0.25% or 0.5% (w/v) sodium hydroxide, which are Examples 7b and 7c, respectively, shown in Table 1. The sodium acetate mixture was heated in an autoclave at 121° C. and 20 psi pressure for 30 min., while the sodium hydroxide mixtures were extracted in a cooker kettle at 80° C. for 30–45 min. Following centrifugation, the fibrous material was refined and formed into paper-like sheets using a Fourdrinier wire papermaker. The resulting sheets were 83.7 to 57.1% lower in Kjeldahl nitrogen content than the shredded stem of Control 5 of Table 1. The sodium hydroxide treatments again resulted in sheets with advantageous qualities compared to the one made via the sodium acetate process.

Reconstituted tobacco paper prepared from tobacco material from Examples 1–4 all exhibited significant reductions in nitrogen content. Treatment of tobacco materials with sodium hydroxide resulted in less paper yields than those treated with sodium acetate or combinations thereof with sodium hydroxide or potassium hydroxide. However, the paper samples formed from the tobacco treated with sodium hydroxide in Examples 3, 4, 5, or 7, as well as those samples treated with potassium hydroxide in Example 5, were stronger and more similar in texture and weight to flue cured tobacco leaf than the paper formed from the tobacco treated with sodium acetate in Examples 1, 2, or 6.

The foregoing detailed description and Examples are given primarily for clearness of understanding and no unnecessary limitations are to be understood therefrom for modifications will become obvious to those skilled in the art upon reading the disclosure and may be made without departing from the spirit of the invention and scope of the appended claims.

What is claimed is:

1. A method of making a tobacco material with reduced levels of nitrogenous compounds comprising:

(a) contacting a tobacco material with a first aqueous solvent to provide an aqueous tobacco extract and a tobacco fiber portion;

(b) separating said aqueous tobacco extract from said tobacco fiber portion;

(c) contacting at a temperature from about 50° C. to 150° C. said tobacco fiber portion with a solution containing sodium hydroxide and potassium hydroxide, wherein said solution contains said sodium hydroxide and potassium hydroxide in a concentration about 0.10% to 10% (w/v) of said solution; and, (d) separating said solution from said tobacco fiber portion.

2. The method of claim 1, further comprising:

(e) contacting said tobacco fiber portion with a second aqueous solvent.

3. The method of claim 1, wherein said tobacco material is contacted with said first aqueous solvent at a temperature of about 60° C. to 80° C. for about 0.5 to 1 hour.

4. The method of claim 1, wherein said tobacco fiber portion is contacted with said solution for about 0.25 to 24 hours.

5. The method of claim 1, wherein said solution is at a pH from about 3.5 to 14.0.

6. The method of claim 1, wherein said tobacco fiber portion is centrifugally separated from said aqueous tobacco extract.

7. The method of claim 1, wherein said tobacco fiber portion is centrifugally separated from said solution.

8. The method of claim 1, further comprising:

(e) processing said fiber portion into a reconstituted tobacco sheet.

9. The method of claim 1, wherein said tobacco fiber portion is contacted with said solution containing about 0.5% to 1.0% (w/v) sodium hydroxide.

10. The method of claim 9, wherein contacting of said tobacco fiber portion with said solution containing about 0.5% to 1.0% (w/v) sodium hydroxide is at a temperature of from about 85° C. to about 90° C. for about 3 to 4 hours.

11. The method of claim 10, further comprising:

(e) processing said fiber portion into a reconstituted tobacco sheet.

12. The method of claim 1, wherein said tobacco fiber portion is contacted with said solution containing about 0.5% to 1.0% (w/v) potassium hydroxide.

13. The method of claim 12, wherein contacting of said tobacco fiber portion with said solution containing about 0.5% to 1.0% (w/v) potassium hydroxide is at a temperature of from about 80° C. to about 90° C. for about 3 to 4 hours.

14. The method of claim 13, further comprising:

(e) processing said fiber portion into a reconstituted tobacco sheet.

15. The method of claim 1 wherein said tobacco material includes flue cured tobacco.

16. The method of claim 1 wherein said tobacco material includes burley tobacco.

17. The method of claim 1, wherein said tobacco fiber portion is contacted with said solution containing about 0.25% (w/v) 0.75% (w/v) sodium hydroxide.

18. The method of claim 17, wherein contacting of said tobacco fiber portion with said solution containing about 0.25% to 0.75% (w/v) sodium hydroxide is at a temperature of from about 85° C. to about 90° C. for about 0.5 to 3.0 hours.

19. The method of claim 18, further comprising:

(e) processing said fiber portion into a reconstituted tobacco sheet.

20. The method of clam 1, wherein said tobacco fiber portion is contacted with said solution containing about 0.25% (w/v) to 0.75% (w/v) potassium hydroxide.

21. The method of claim 20, wherein contacting of said tobacco fiber portion with said solution containing about 0.25% to 0.75% (w/v) potassium hydroxide is at a temperature of from about 85° C. to about 90° C. for about 0.5 to 3.0 hours.

22. The method of claim 21, further comprising:

(e) processing said fiber portion into a reconstituted tobacco sheet.

23. The method of claim 1, further comprising:

(e) contacting said tobacco fiber portion after said separation from said solution with a selected portion of said tobacco extract.

24. A method of making a tobacco material with reduced levels of nitrogenous compounds comprising:

(a) contacting a tobacco material with a first aqueous solvent to provide an aqueous tobacco extract and a tobacco fiber portion;

(b) separating said aqueous tobacco extract from said tobacco fiber portion;

(c) contacting at a temperature from about 50° C. to 150° C. said tobacco fiber portion with a solution containing a compound selected from the group consisting of sodium hydroxide and potassium hydroxide, wherein said solution contains said compound in a concentration about 0.10% to 10% (w/v) of said solution; and, (d) separating said solution from said tobacco fiber portion.

25. The method of claim 24, further comprising:

(e) contacting said tobacco fiber portion with a second aqueous solvent.

26. The method of claim 24, wherein said tobacco material is contacted with said first aqueous solvent at a temperature of about 60° C. to 80° C. for about 0.5 to 1 hour.

27. The method of claim 24, wherein said tobacco fiber portion is contacted with said solution for about 0.25 to 24 hours.

28. The method of claim 24, wherein said solution is at a pH from about 3.5 to 14.0.

29. The method of claim 24, wherein said tobacco fiber portion is centrifugally separated from said aqueous tobacco extract.

30. The method of claim 24, wherein said tobacco fiber portion is centrifugally separated from said solution.

31. The method of claim 24, further comprising:

(e) processing said fiber portion into a reconstituted tobacco sheet.

32. The method of claim 24, wherein said tobacco fiber portion is contacted with said solution containing about 0.5% to 1.0% (w/v) sodium hydroxide.

33. The method of claim 32, wherein contacting of said tobacco fiber portion with said solution containing about 0.5% to 1.0% (w/v) sodium hydroxide is at a temperature of from about 85° C. to about 90° C. for about 3 to 4 hours.

34. The method of claim 33, further comprising:

(e) processing said fiber portion into a reconstituted tobacco sheet.

35. The method of claim 24, wherein said tobacco fiber portion is contacted with said solution containing about 0.5% to 1.0% (w/v) potassium hydroxide.

36. The method of claim 35, further comprising:

(e) processing said fiber portion into a reconstituted tobacco sheet.

37. The method of claim 24, wherein said tobacco material includes flue cured tobacco.

38. The method of claim 24, wherein said tobacco material includes burley tobacco.

39. The method of claim 38, wherein said tobacco fiber portion is contacted with said solution containing about 0.25% (w/v) to 0.75% (w/v) sodium hydroxide.

40. The method of claim 39, wherein contacting of said tobacco fiber portion with said solution containing about 0.25% (w/v) to 0.75% (w/v) sodium hydroxide is at a temperature of from about 85° C. to about 90° C. for about 0.5 to 3.0 hours.

41. The method of claim 40, further comprising:

(e) processing said fiber portion into a reconstituted tobacco sheet.

42. The method of claim 38, wherein said tobacco fiber portion is contacted with said solution containing about 0.25% (w/v) to 0.75% (w/v) potassium hydroxide.

43. The method of claim 42, wherein contacting of said tobacco fiber portion with said solution containing about 0.25% to 0.75% (w/v) potassium hydroxide is at a temperature of from about 85° C. to about 90° C. for about 0.5 to 3.0 hours.

44. The method of claim 43, further comprising:

(e) processing said fiber portion into a reconstituted tobacco sheet.

45. The method of claim 24, further comprising:

(e) contacting said tobacco fiber portion after said separation from said solution with a selected portion of said tobacco extract.

* * * * *